US012031393B2

(12) United States Patent
Roensberg et al.

(10) Patent No.: US 12,031,393 B2
(45) Date of Patent: Jul. 9, 2024

(54) DRILLING PLANTS AND METHODS

(71) Applicant: MHWIRTH AS, Kristiansand S (NO)

(72) Inventors: Per Inge Roensberg, Kristiansand (NO); Roy Birkeland, Nodeland (NO); Ellen Kolnes, Kristiansand (NO); Nicolai Nilsen, Kristiansand (NO); Jarle Ropstad, Soegne (NO); Bjarne Larsen, Kristiansand S (NO); Soeren Oeydna, Kristiansand (NO); Lars Otto Sannes, Hamresanden (NO)

(73) Assignee: MHWIRTH AS, Kristiansand S (NO)

( * ) Notice: Subject to any disclaimer, the term of this patent is extended or adjusted under 35 U.S.C. 154(b) by 29 days.

(21) Appl. No.: 17/785,912

(22) PCT Filed: Dec. 17, 2020

(86) PCT No.: PCT/NO2020/050318
§ 371 (c)(1),
(2) Date: Jun. 16, 2022

(87) PCT Pub. No.: WO2021/125973
PCT Pub. Date: Jun. 24, 2021

(65) Prior Publication Data

US 2023/0023261 A1 Jan. 26, 2023

(30) Foreign Application Priority Data

Dec. 19, 2019 (GB) ..... 1918795

(51) Int. Cl.
*E21B 19/15* (2006.01)
*B63B 35/44* (2006.01)
(Continued)

(52) U.S. Cl.
CPC ..... *E21B 19/155* (2013.01); *B63B 35/4413* (2013.01); *E21B 19/006* (2013.01); *E21B 19/15* (2013.01); *E21B 19/20* (2013.01)

(58) Field of Classification Search
CPC ..... E21B 19/155; E21B 19/006; E21B 19/20; E21B 19/15; E21B 19/00; B63B 35/4413
See application file for complete search history.

(56) References Cited

U.S. PATENT DOCUMENTS 4,834,604 A 5/1989 Brittain et al.
5,458,454 A 10/1995 Sorokan
(Continued)

FOREIGN PATENT DOCUMENTS

EP 0 592 653 A1 4/1994
GB 2577290 A 3/2020
(Continued)

*Primary Examiner* — Brad Harcourt
(74) *Attorney, Agent, or Firm* — Norman B. Thot

(57) ABSTRACT

A drilling rig includes a drill floor with a well center opening, a derrick having a drilling machine which is suspended above the well center opening, a pipe supply area which is arranged adjacent to the well center opening on the drill floor, and a pipe handling machine. The pipe supply area has at least one pipe rack which horizontally stores pipe sections. The pipe handling machine moves at least one of the pipe sections between a horizontal storage position in the at least one pipe rack and a vertical position or a substantially vertical position above the well center opening.

22 Claims, 11 Drawing Sheets

(51) Int. Cl.
*E21B 19/00* (2006.01)
*E21B 19/20* (2006.01)

(56) References Cited

U.S. PATENT DOCUMENTS 5,941,324 A * 8/1999 Bennett ..... E21B 19/14 175/85
6,321,675 B1 * 11/2001 Dybdahl ..... B63B 35/4413 114/264
6,343,893 B1 2/2002 Gleditsch
9,212,526 B1 12/2015 Barnes et al.
2002/0153169 A1 * 10/2002 Sewell ..... B65G 1/08 175/85
2009/0263221 A1 10/2009 Oldershaw
2009/0279987 A1 * 11/2009 Jantzen ..... E21B 15/04 414/22.53
2010/0032213 A1 2/2010 Orgeron
2010/0104401 A1 * 4/2010 Hopkins ..... E21B 19/155 414/800
2011/0240305 A1 10/2011 Kristensen et al.
2012/0097454 A1 4/2012 Kockeis et al.
2013/0341013 A1 * 12/2013 Flusche ..... E21B 19/16 166/250.15
2014/0027395 A1 * 1/2014 Benoit ..... E21B 19/14 211/70.4
2014/0196948 A1 * 7/2014 Kannegaard ..... E21B 19/155 175/5
2019/0330933 A1 * 10/2019 Mikalsen ..... B25J 11/00
2019/0376354 A1 12/2019 McIver et al.
2021/0355758 A1 11/2021 Lien et al.
2022/0136343 A1 5/2022 Wythes et al.

FOREIGN PATENT DOCUMENTS

WO WO 2005/073497 A1 8/2005
WO WO 2010/062613 A2 6/2010
WO WO 2020/168377 A 8/2020

* cited by examiner

DRILLING PLANTS AND METHODS

CROSS REFERENCE TO PRIOR APPLICATIONS

This application is a U.S. National Phase application under 35 U.S.C. § 371 of International Application No. PCT/NO2020/050318, filed on Dec. 17, 2020 and which claims benefit to Great Britain Patent Application No. 1918795.4, filed on Dec. 19, 2019. The International Application was published in English on Jun. 24, 2021 as WO 2021/125973 A1 under PCT Article 21(2).

FIELD

The present invention relates to drilling plants and methods, and in particular to drilling plant methods and systems for handling drilling equipment and tubulars on a drilling vessel.

BACKGROUND

Offshore drilling is commonly carried out on floating vessels, e.g., semi-submersible drilling rigs or drillships. Such vessels commonly have machines which allow equipment and tubulars to be transported from a storage area to the drill floor for use, for example, sections of drill pipe to be used for drilling. Some examples of such machines are cranes, vertical pipe handlers, and so-called catwalk machines. At the drill floor, the equipment or tubulars are then commonly handled by so-called top drives and roughneck machines and used, for example, for making new hole (i.e., drilling).

Tubulars, such as sections of riser or drill pipe, are commonly stored horizontally in a tubular storage area and fed to a tubular feeding machine (e.g., a catwalk machine), and then to the drill floor. At the drill floor, the tubulars may be made up into stands, which comprise more than one section of pipe, and are typically stored vertically in a so-called setback-fingerboard pipe storage.

Such floating drilling vessels are highly expensive to operate, and it is therefore important that the feeding and handling of, for example, drill pipe can be done efficiently, reliably, and without interruption in order to reduce or eliminate downtime as much as possible.

During wellbore operations, such as drilling or tripping pipe, it is also desirable that the handling of the drill string by the equipment on the drill floor is carried out in a manner which reduces the risk of damage to equipment or to the well to the greatest extent possible.

There is therefore a continuous need for improved systems and methods which can accommodate one or more of these requirement for various drilling vessel designs.

SUMMARY

An aspect of the present invention is to provide improved or alternative methods and systems for handling tubulars and other equipment on a drilling vessel.

In an embodiment, the present invention provides a drilling rig which includes a drill floor comprising a well center opening, a derrick comprising a drilling machine which is suspended above the well center opening, a pipe supply area which is arranged adjacent to the well center opening on the drill floor, and a pipe handling machine. The pipe supply area comprises at least one pipe rack which is configured to horizontally store a plurality of pipe sections. The pipe handling machine is configured to move at least one of the plurality of pipe sections between a horizontal storage position in the at least one pipe rack and a vertical position or a substantially vertical position above the well center opening

BRIEF DESCRIPTION OF THE DRAWINGS

The present invention is described in greater detail below on the basis of embodiments and of the drawings in which.

DETAILED DESCRIPTION

Figure 1:
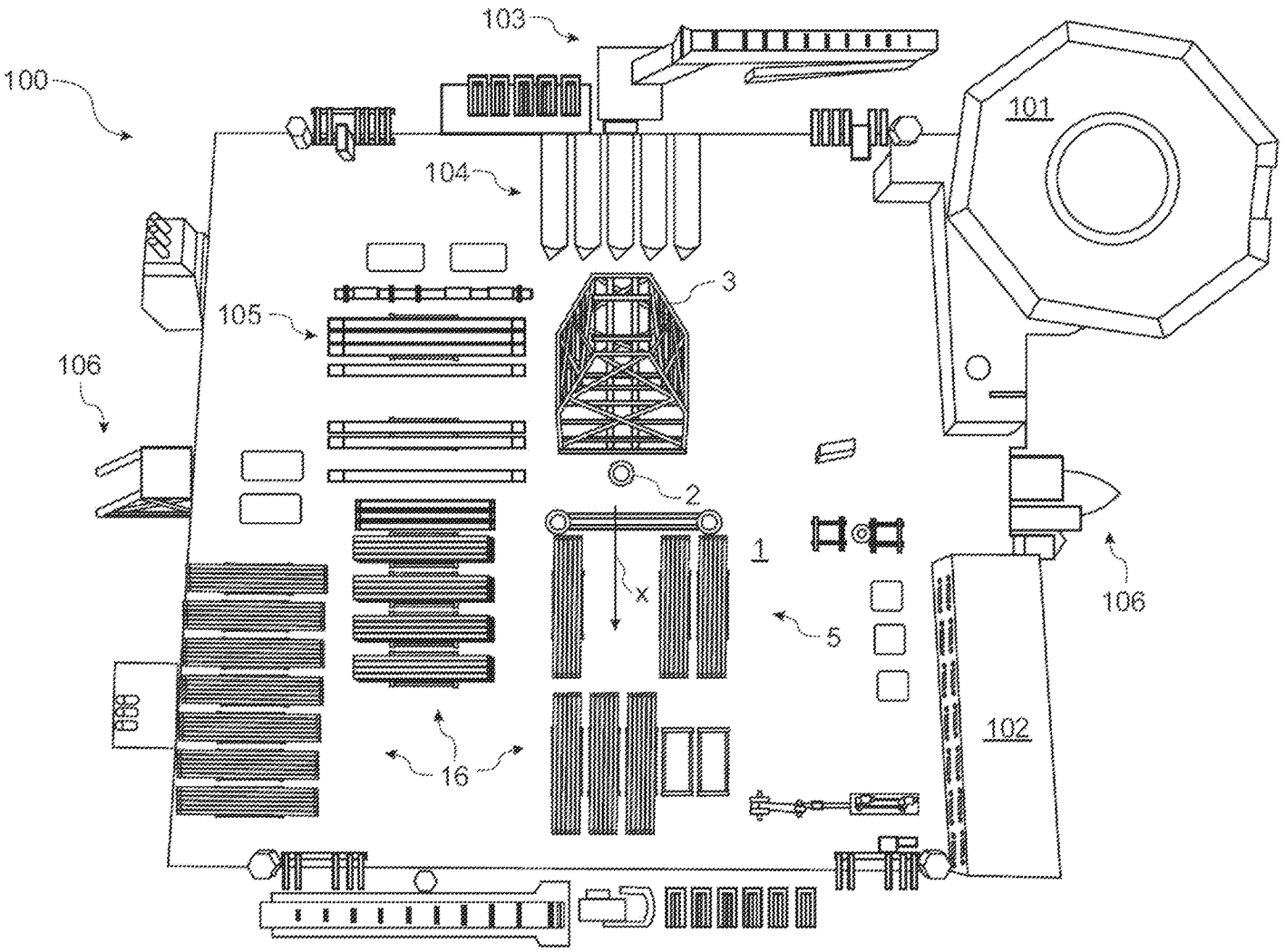
FIG. 1 shows a perspective view of a drilling rig.

An aspect of the present invention provides a drilling rig having: a drill floor with a well center opening; a derrick with a drilling machine suspended above the well center opening; a pipe supply area arranged adjacent the well center opening on the drill floor, the pipe supply area comprising at least one pipe rack for horizontal storage of a plurality of pipe sections, and a pipe handling machine operable to move pipe sections between a horizontal storage position in the pipe rack and a vertical or substantially vertical position above the well center opening.

An aspect of the present invention provides a method of providing pipe sections to a drilling machine suspended above a well center opening on a drilling rig, the method comprising: operating a pipe handling machine to pick up pipe sections from a horizontal storage position in a pipe rack arranged in a pipe supply area within operational reach of the pipe handling machine, and operating the pipe handling machine to bring the pipe sections to a vertical or substantially vertical position above the well center opening.

An aspect of the present invention provides a drilling rig having: a drill floor with a well center opening; a derrick with a drilling machine suspended above the well center opening; a vertical pipe handling machine operable to handle a tubular above the well center opening; wherein the well center opening is provided on a compensated section of the drill floor, the compensated section being vertically movable in relation to a remainder of the drill floor.

The following description may use terms such as "horizontal", "vertical", "lateral", "back and forth", "up and down", "upper", "lower", "inner", "outer", "forward", "rear", etc. These terms generally refer to the views and orientations as shown in the drawings and that are associated with a normal use of the present invention. The terms are used for the reader's convenience only and shall not be limiting.

These and other characteristics will become clear from the following description of illustrative embodiments, given as non-restrictive examples, with reference to the attached drawings.

FIG. 1 shows an overview of a drilling rig 100 having a drill floor 1. The drilling rig 100 comprises various general parts which will be familiar to those skilled in the art, including a helicopter deck 101, office space 102, a crane 103, equipment containers 104, a riser storage 105, and lifeboats 106. The drilling rig 100 may be an offshore rig, e.g., a floating offshore rig such as a semi-submersible or a drillship, or it may be a platform offshore rig. Embodiments described here may be particularly suitable for use with such offshore rigs where requirements for efficient pipe handling and logistics may be demanding, and space restrictions apply.

The drill floor 1 further has a well center opening 2 and a derrick 3 with a drilling machine 4 (see FIG. 4), for example, a so-called top drive, suspended above the well center opening 2. A pipe supply area 5 is arranged adjacent to the well center opening 2 on the drill floor 1.

Figure 2:
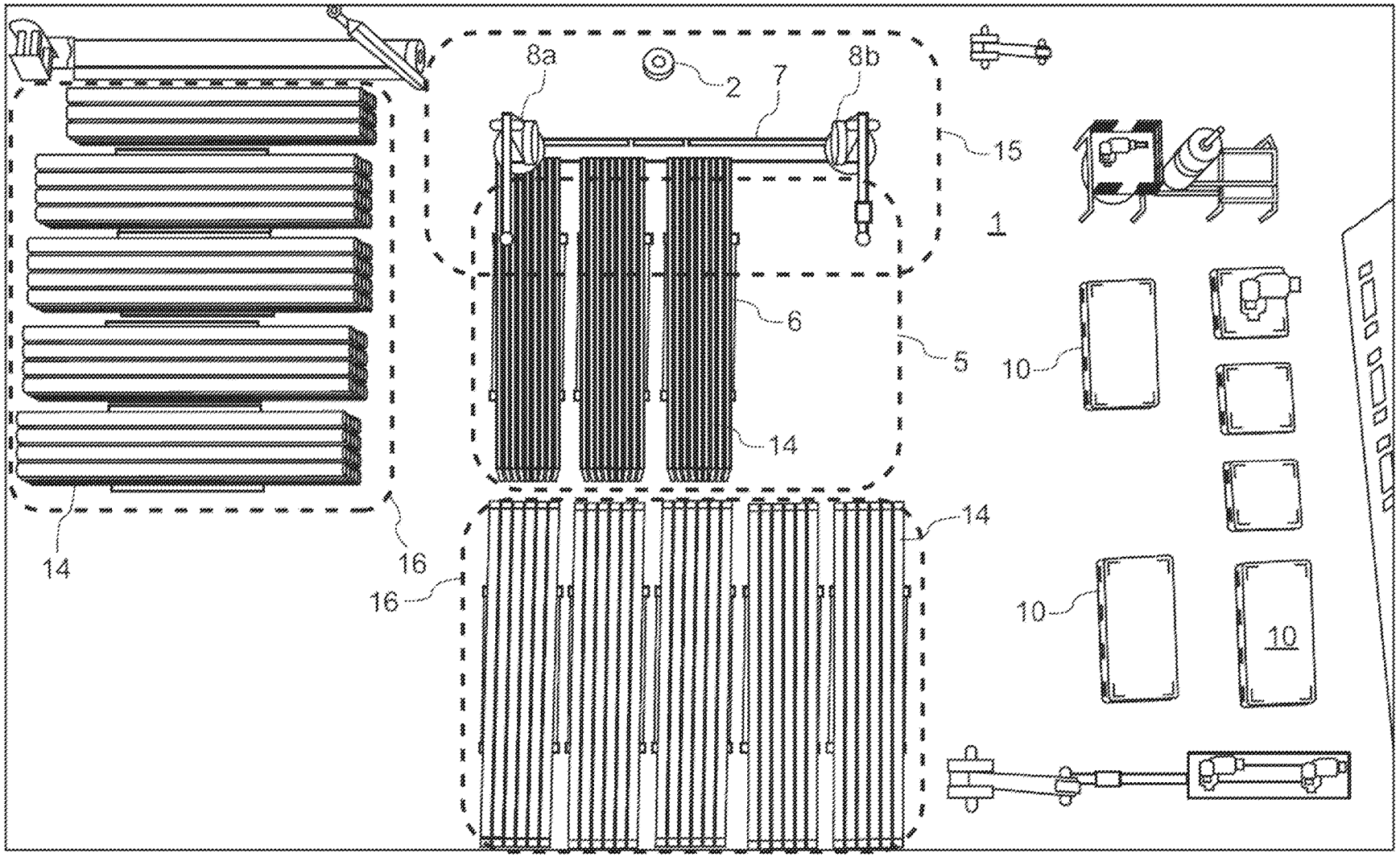
FIG. 2 shows a close-up illustration of a part of the drill floor.

Now referring to FIG. 2, which shows a close-up illustration of a part of the drill floor 1, the pipe supply area 5 comprises one or several pipe racks 6 for horizontal storage of a plurality of pipe sections 14,14'. A pipe handling machine 8*a* is operable to move pipe sections 14 stored in the pipe racks 6 between a horizontal storage position in the pipe racks 6 and a vertical or substantially vertical position above the well center opening 2. This will be described in greater detail below. In the embodiments described here, two pipe handling machines 8*a,b* are provided, however, there may be only one pipe handling machine 8*a,b*, or more than two.

The pipe sections 14 may be pieces of drill pipe, well casing, or other tubulars to be used in well operations, such as the well construction process or well intervention. Such pipe sections will be provided to the drilling rig 100 in sections, i.e., as individual pieces of pipe with tool joints for connection together into a pipe string.

The pipe sections 14, when in the horizontal storage position in the pipe racks 6, can, for example, be arranged substantially parallel to an axis x (see FIG. 1) extending from the well center opening 2 and towards the pipe supply area 5. In other words, the pipe sections 14 are arranged with an end therefore adjacent, or pointing towards, the well center opening 2 and the derrick 3, and extending away from the derrick 3. This may provide advantages in the pipe handling, as will be clear from the more detailed description below.

The pipe supply area 5 is arranged within an operational reach 15 (indicated by a dashed line in FIG. 2) of the pipe handling machine(s) 8*a,b*. The pipe handling machines 8*a,b* may thereby pick up or lay down pipe sections 14 from or in the pipe racks 6. Still referring to FIG. 2, the drilling rig 100 further comprises a pipe storage area 16 which is spaced from the pipe supply area 5, and outside the operational reach 15 of the pipe handling machine(s) 8*a,b*.

The pipe supply area 5 and the pipe storage area 16 may both be arranged on the drill floor 1 or on a horizontal extension of the drill floor 1 so that there is no height difference between the pipe supply area 5 and the pipe storage area 16.

The pipe supply area 5 may advantageously comprise a plurality of pipe racks 6, and each pipe rack 6 can be movable into or out of the pipe supply area 5. For example, each pipe rack 6 may be arranged with a frame structure 9 (see FIGS. 3 and 8) having a receptacle for holding the pipe sections 14. The receptacle for the pipe section may be defined by parallel, vertical sides or side walls 9' (see FIG. 8).

Figure 3:
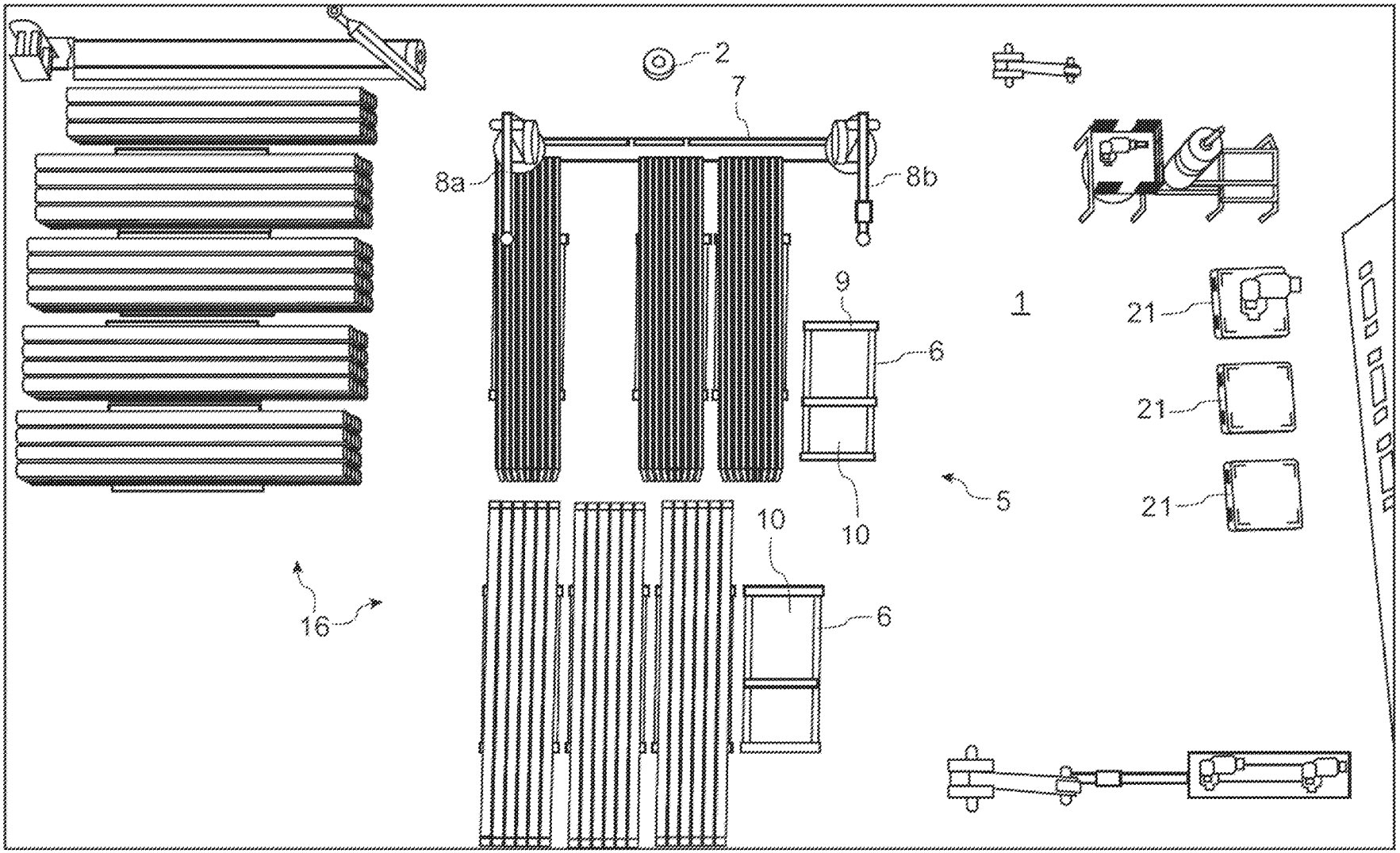
FIG. 3 shows a drill floor area and in particular two utility vehicles in operation moving two empty pipe racks.

Advantageously, there is provided one or more utility vehicles 10 movable on the drill floor 1 and wherein the pipe racks 6 are movable by the utility vehicle 10. FIG. 2 illustrates three utility vehicles 10 on the drill floor 1. The utility vehicles 10 are driveable/movable on the drill floor 1 so that they can engage one of the pipe racks 6 and move the pipe rack 6 within the pipe supply area 5 or into, or out of, the pipe supply area 5. The utility vehicles 10 may move the pipe racks 6 when the pipe racks 6 hold pipe sections 14, or when they are empty. FIG. 3 illustrates two utility vehicles 10 in operation moving two empty pipe racks 6.

Figure 7:
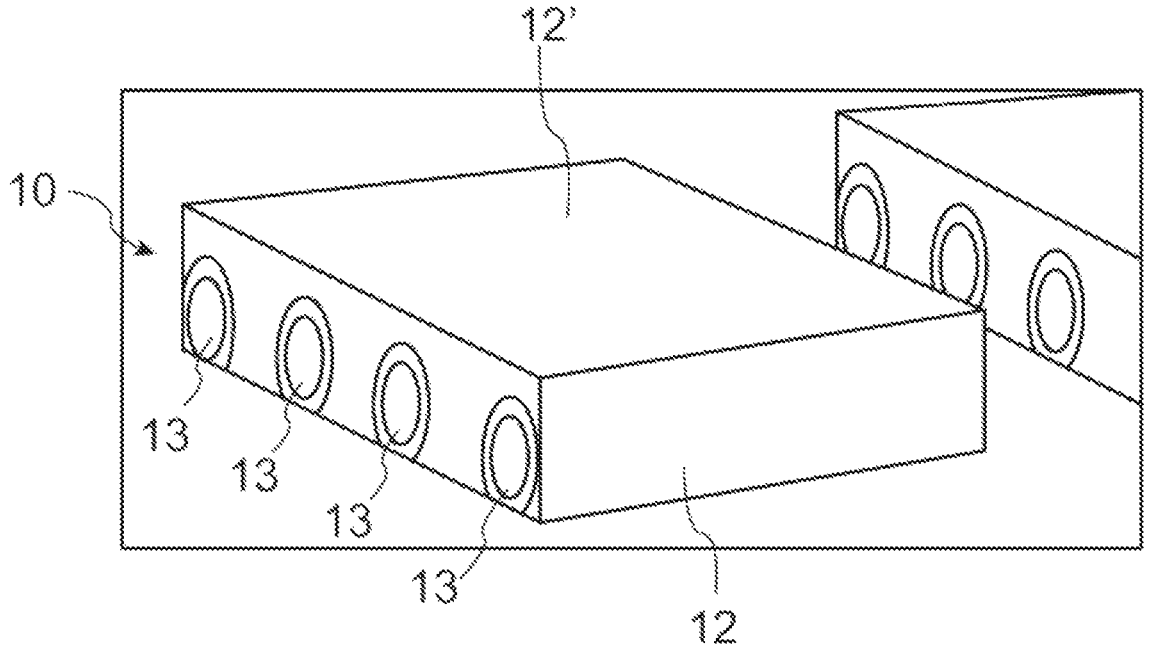
FIG. 7 shows a utility vehicle.

FIG. 7 illustrates a utility vehicle 10 in more detail. The utility vehicle 10 has a base 12, a drive apparatus (not shown here) and ground engaging motive apparatus 13 upon which the base 12 is supported on the drill floor 1. The base 12 may, for example, be a rigid (e.g., steel) frame, and the drive apparatus may, for example, be electric or hydraulic motors arranged in the base 12. The motive apparatus 13 is illustrated as a plurality of wheels, but may alternatively, for example, be tracks with sprocket wheels to drive the utility vehicle 10. The drive apparatus is thus operable to drive the motive apparatus 13 to move the utility vehicle 10 across the drill floor 1.

The motive apparatus 13 can be drivable to change the direction of travel of the utility vehicle 10 at any point on the drill floor 1. This may allow the utility vehicle 10 to move freely on the drill floor 1, i.e., not restricted to any particular routes or areas. This may, for example, be done by providing the wheels (in this embodiment) with turning capability, e.g., to make the wheels turnable by 90 degrees. The motive apparatus 13 may alternatively be controllable to allow the vehicle 10 to turn about a vertical axis, e.g., by driving the motive apparatus 13 on either side of the utility vehicle 10 in different directions.

The motive apparatus 13 can alternatively be configured to drive along pre-defined rails or tracks on the drill floor 1 if desirable. This may allow the use of other types of motive apparatus 13, for example, metallic wheels engaging corresponding rails or tracks in the drill floor 1.

In this embodiment, the base 12 has a generally planar uppermost surface 12' configured to support the pipe rack 6 while the pipe rack 6 is moved by the utility vehicle 10. For this purpose, the pipe racks 6 may have an underdrive part 11, indicated in FIG. 4, where the utility vehicle 10 can be positioned at least partly under the pipe rack 6. The utility vehicle 10 can then be made operable to elevate the pipe rack 6 off the drill floor 1 and move the pipe rack 6 while holding the pipe rack 6 elevated. The wheels (or any other type of motive apparatus 13 used) can, for example, be provided with e.g., a gas suspension which allows the base 12 to be raised and lowered. The base 12 or uppermost surface 12' can alternatively be provided with a lifting device, such as a jack or lifting cylinder arrangement, which can engage the pipe rack 6 and lift it off the drill floor 1. As can be seen from the drawings, such as FIG. 4, the pipe racks 6 can have legs upon which the pipe racks 6 rest on the drill floor 1 when positioned in place.

The utility vehicles 10 can be provided with a wireless control signal receiver from which it may receive wireless control signals from a remote controller. The control signals can then control the operation of the drive apparatus. The utility vehicle 10 can thereby be remotely controlled so that the need for personnel to be present on the drill floor 1 is reduced.

Advantageously, each pipe rack 6 can thus be arranged to be movable between the pipe supply area 5 and the pipe storage area 16 by the utility vehicle 10. For this purpose, the utility vehicle 10 can be made driveable between the pipe supply area 5 and the pipe storage area 16, as can be seen from e.g., FIG. 2, where the pipe supply area 5 and the pipe storage area 16 are arranged on a common, continuous deck on which the utility vehicles 10 are drivable.

Advantageously, the pipe supply area 5 is configured for storage of pipe sections 14 in the form of single sections of well pipe, i.e., so-called "singles". Singles are single sections of pipe or collar, i.e., a pipe or collar which is not made up of two sections screwed together. By providing an arrangement as here described in the embodiments, an efficient operation can also be achieved with singles, and the need for equipment to build (or break out) stands, as well as arrangement to store stands, is eliminated. The pipe supply area 5 can thus comprise pipe sections 14 in the form of single sections of well pipe stored in the at least one pipe rack 6. The well pipe can, for example, be drill pipe or well casing.

Figure 4:
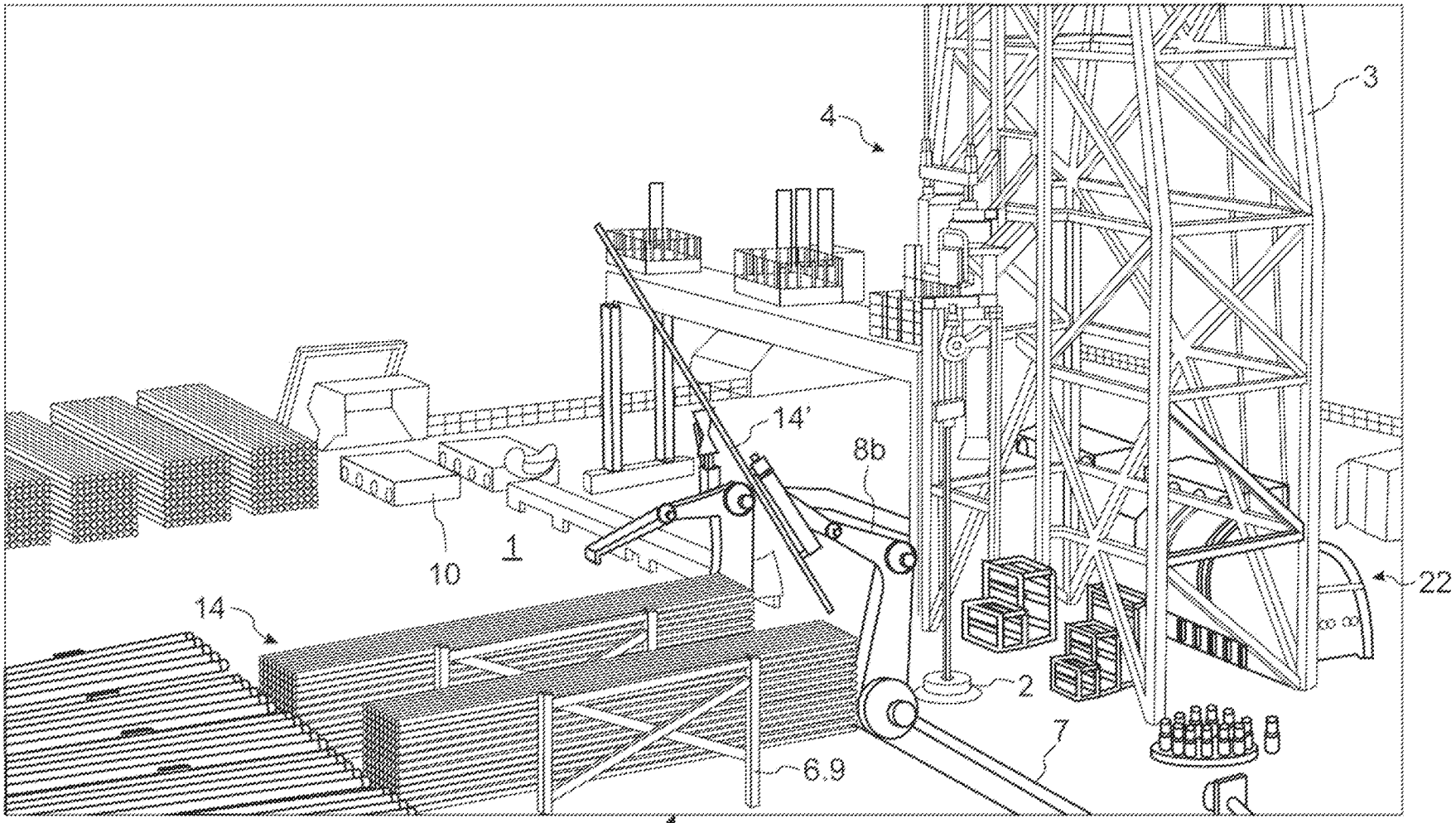
FIG. 4 shows a drill floor and a sequence of steps in a use of a drilling rig, in particular where a handling machine has picked up a pipe section from the pipe rack arranged in the pipe supply area.

As can be seen from FIGS. 2 and 4, the pipe handling machines 8*a,b* are movable on the drill floor 1 in a direction substantially perpendicular to an axis x (see FIG. 1) extending from the well center opening 2 and towards the pipe supply area 5. The axis x is perpendicular to the longitudinal direction of the pipe sections 14 as stored in the pipe supply area 5. The pipe handling machines 8*a,b* can be arranged on tracks or rails 7 arranged on the drill floor 1 for this purpose, whereby they are movable relative to the well center opening 2 and to the pipe supply area 5, as shown. One or both of the pipe handling machines 8*a,b* may alternatively be fixed in relation to the drill floor 1 and arranged with a sufficient reach so that it/they can reach the well center opening 2 area and have a sufficient reach in the pipe supply area 5 to pick up and lay down pipe sections 14 without having to be movable on the drill floor 1.

Figure 8:
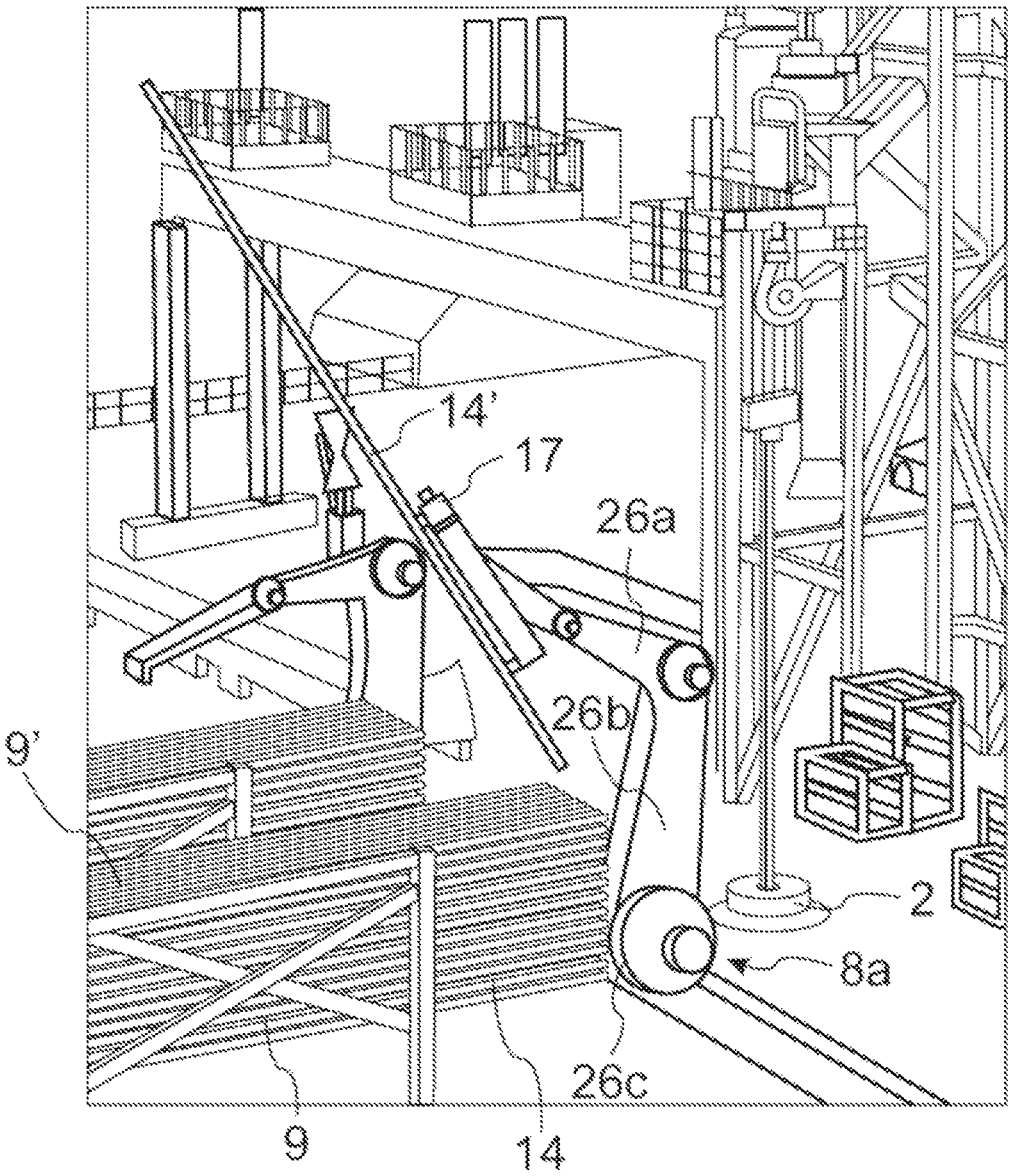
FIG. 8 shows details of a drilling rig.

FIG. 8 illustrates the pipe handling machine 8*a* in more detail. The pipe handling machine 8*a* in this embodiment comprises two articulated arms 26*a,b* arranged on a base 26*c*. The base 26*c* is supported on the drill floor 1, in these embodiments, on the tracks or rails 7 to make the entire pipe handling machine 8*a* movable sideways, as described above. The base 26*c* supports the lower articulated arm 26*b* and is provided with functionality so that the arm 26*b* can be rotated about a vertical axis. The upper articulated arm 26*a* is mounted on the lower articulated arm 26*b* and provided with a pipe gripper head 17 which is operable to grip and hold a pipe section 14. The pipe gripper head 17 is arranged pivotable on the upper articulated arm 26*a*, whereby it is operable to engage a pipe section 14 horizontally at the pipe racks 6 and vertically above the well center opening 2 or in the area around the well center opening 2.

As will be appreciated, the detailed design of the pipe handling machines 8*a,b* may differ from the example embodiment shown here, for example, having more or less articulated arms or variations in the gripper head arrangement, while still being able to provide the same function.

Use of the drilling rig 100 according to embodiments described here will now be outlined with reference to the drawings and the description above.

With reference to FIG. 1, the drilling plant may, for example, be used for a well construction process, i.e., to drill a new well, or in a well intervention operation. In both cases, tubular strings will be built and suspended into the well by the drilling machine 4. This may include a drill string, which may have to be built, used, and retrieved, for example, for changing the drill bit, and then built again to continue drilling. Between drilling different sections of the well, there may be a need to secure the wellbore with casing, which will also be built from pipe sections and lowered into the well in the same manner.

Several pipe racks 6 with pipe may be positioned in the pipe supply area 5 for picking up by the pipe handling machine(s) 8*a,b*. The pipe handling machine(s) 8*a,b* is (are) then operated to pick up pipe sections and to bring them to the well center area 2, where they can be added to the string. Similarly, when withdrawing a pipe string, such as a drill string, the pipe handling machine(s) 8*a,b* can be operated to retrieve pipe sections 14 which are broken out of the string and lay them down horizontally in one of the pipe racks 6.

As can be seen from FIGS. 2-6, this arrangement provides significant flexibility in relation to the logistics of the pipe sections 14 on the drill floor 1. By moving the pipe racks 6 into and out of the pipe supply area 5, sufficient pipe sections 14 can be made available to build a string, and/or space to lay down retrieved pipe sections 14 is available in the pipe racks 6. The pipe racks 6 can be moved individually, whereby when a pipe rack 6 is empty, it can be removed and a new one moved to the pipe supply area 5.

The pipe supply area 5 and the pipe storage area 16 can be arranged to hold different types of pipe sections 14 according to the given operation. For example, when a section of the well has been drilled and is due for casing, casing pipe can be moved from the pipe storage area 16 to the pipe supply area 5 to be ready for use, while at the same time empty pipe racks 6 are provided in the pipe supply area 5 to receive and store the retrieved pipe sections 14 which are broken out of the drill string as it is retrieved. Once the drill string is retrieved, building of the casing string can start. FIG. 2 shows, for example, four different sizes of pipe in the pipe supply area 5, three pipe racks 6 with drill pipe, while three different sizes of well casing is stored in the pipe storage area 16.

As can be seen in FIG. 3, other free-moving trolleys 21 can also be provided for carrying out other operations, such as transport of tools or equipment, or for assisting processes on the drill floor 1.

Figure 5:
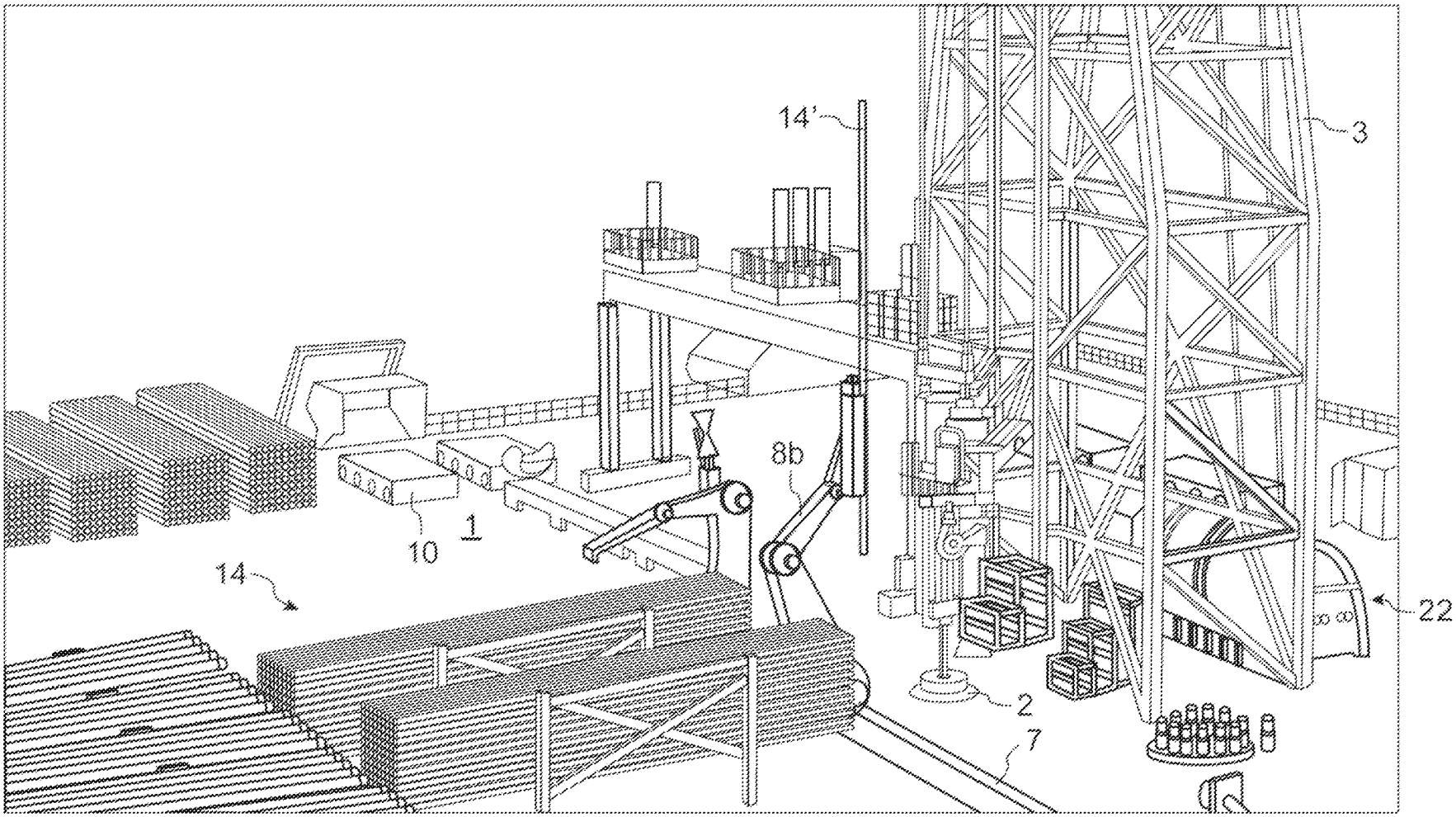
FIG. 5 shows a drill floor and a sequence of steps in a use of a drilling rig, in particular where, by means of the base being movable and rotatable, the pipe handling machine turns towards the derrick and the well center opening so that the pipe handling machine is ready to provide the pipe section to the drilling machine.
Figure 6:
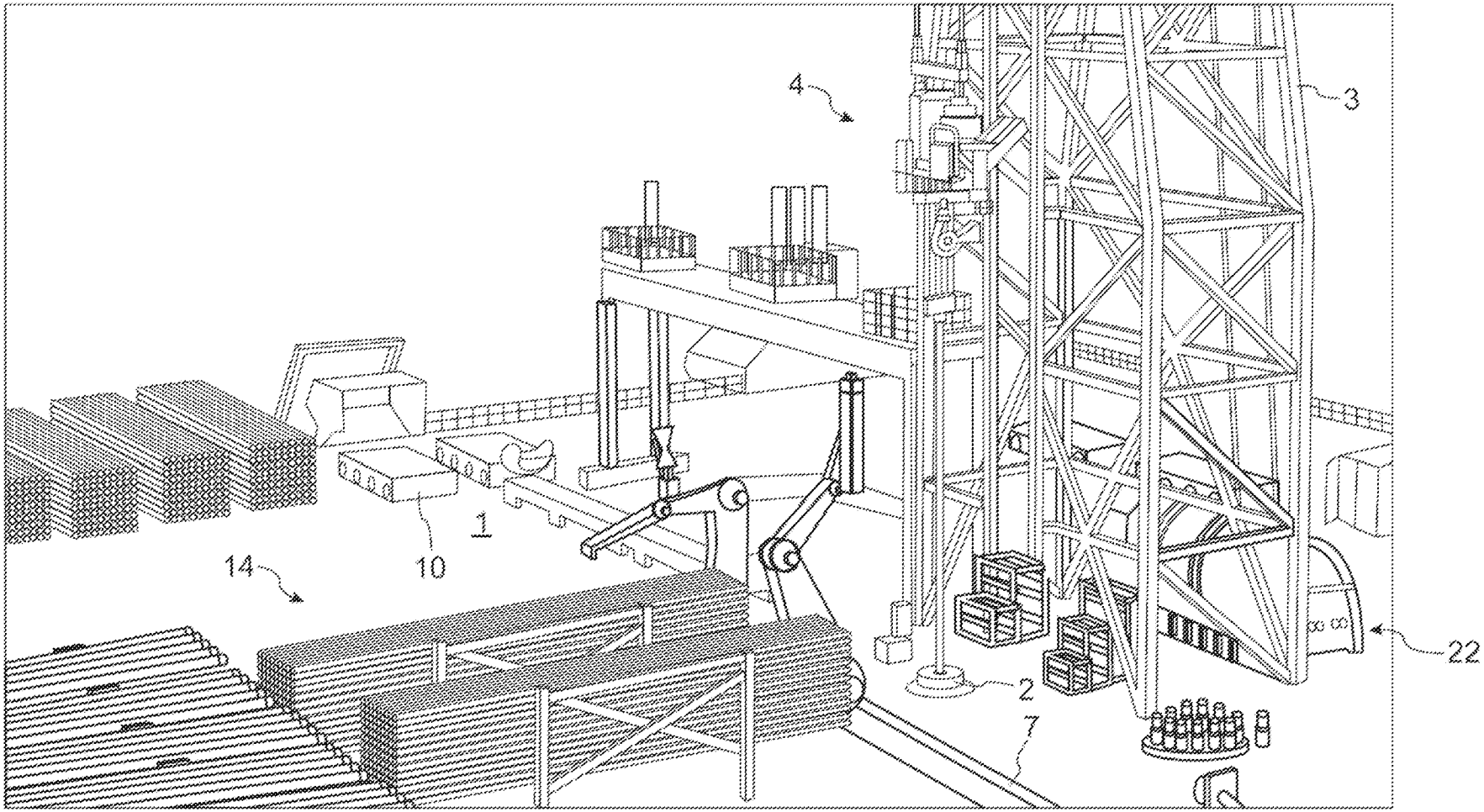
FIG. 6 shows a drill floor and a sequence of steps in a use of a drilling rig, in particular where the drilling machine has been hoisted and has received the new pipe section from the pipe handling machine.

FIGS. 4-6 illustrate parts of a sequence where the arrangement as described above is used to build a drill string. In FIG. 4, the pipe handling machine 8*b* has picked up a pipe section 14' from the pipe rack 6 arranged in the pipe supply area 5. The drilling machine 4 is carrying out a drilling operation during this process, i.e., rotating the drill string and lowering the drill string into the well.

By means of the base 26*c* (see FIG. 8) being movable and rotatable, the pipe handling machine 8*b* turns towards the derrick 3 and well center opening 2. This is shown in FIG. 5 where the pipe handling machine 8*b* is ready to provide the pipe section 14' to the drilling machine 4. The drilling machine is just completing drilling the preceding pipe section 14; the drill string will be hung off in the well center opening 2, and the drilling machine 4 hoisted by the hoisting system 22 (here illustrated as a winch/drawworks.)

In FIG. 6, the drilling machine 4 has been hoisted and has received the new pipe section 14' from the pipe handling machine 8*b*. The new pipe section 14' has been screwed into the drill string and connected to the drilling machine 4 so that drilling can continue. The pipe handling machine 8*b* can turn back towards the pipe racks 6 to pick up a new pipe section 14, to repeat the same steps.

Figure 9:
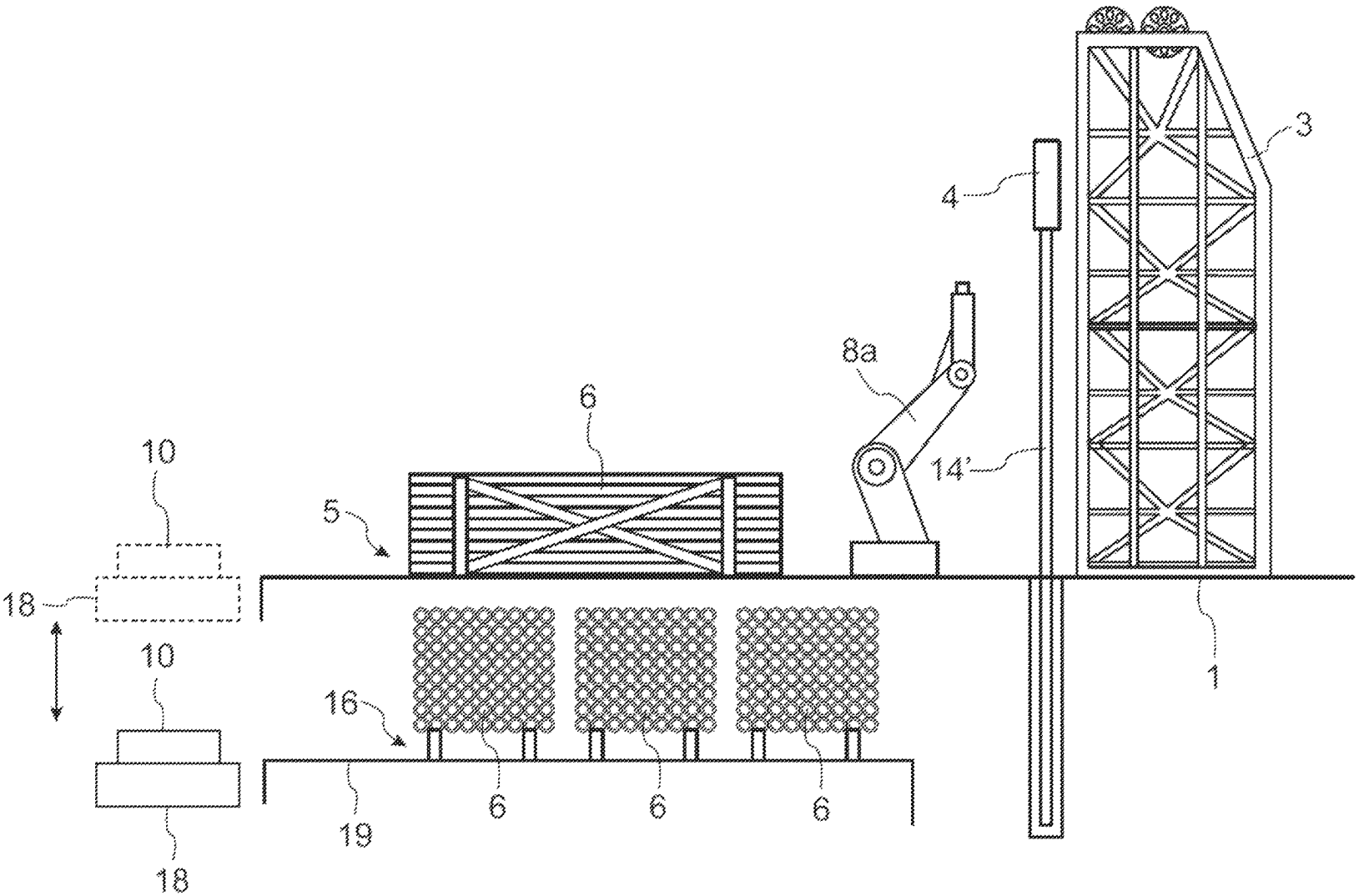
FIG. 9 shows an aspect of a drilling rig having an elevator in which at least a part of the pipe storage area is arranged at a different elevation than the pipe supply area.

FIG. 9 illustrates another embodiment in which at least a part of the pipe storage area 16 is arranged at a different elevation than the pipe supply area 5. The different elevation may be a different deck, for example, a deck 19 which is lower than the drill floor 1 and/or the deck which forms the pipe supply area 5. The utility vehicle 10 can be operable to move pipe racks 6 between the (in this embodiment) lowered pipe storage area 16 to the pipe supply area 5 via an elevator 18 (shown only schematically in FIG. 9). The elevator 18 can move up and down, as indicated by the double arrow in FIG. 9, and be arranged adjacent and level with each of the two decks. The utility vehicle 10 is then arranged to be driveable onto the elevator 18 from each of the decks.

The pipe supply area 5 may be arranged at the same height or elevation as the drill floor 1. The pipe storage area 16, or a part thereof, may be arranged at a deck which is lower than the pipe supply area 5 and/or the drill floor 1.

Figure 10:
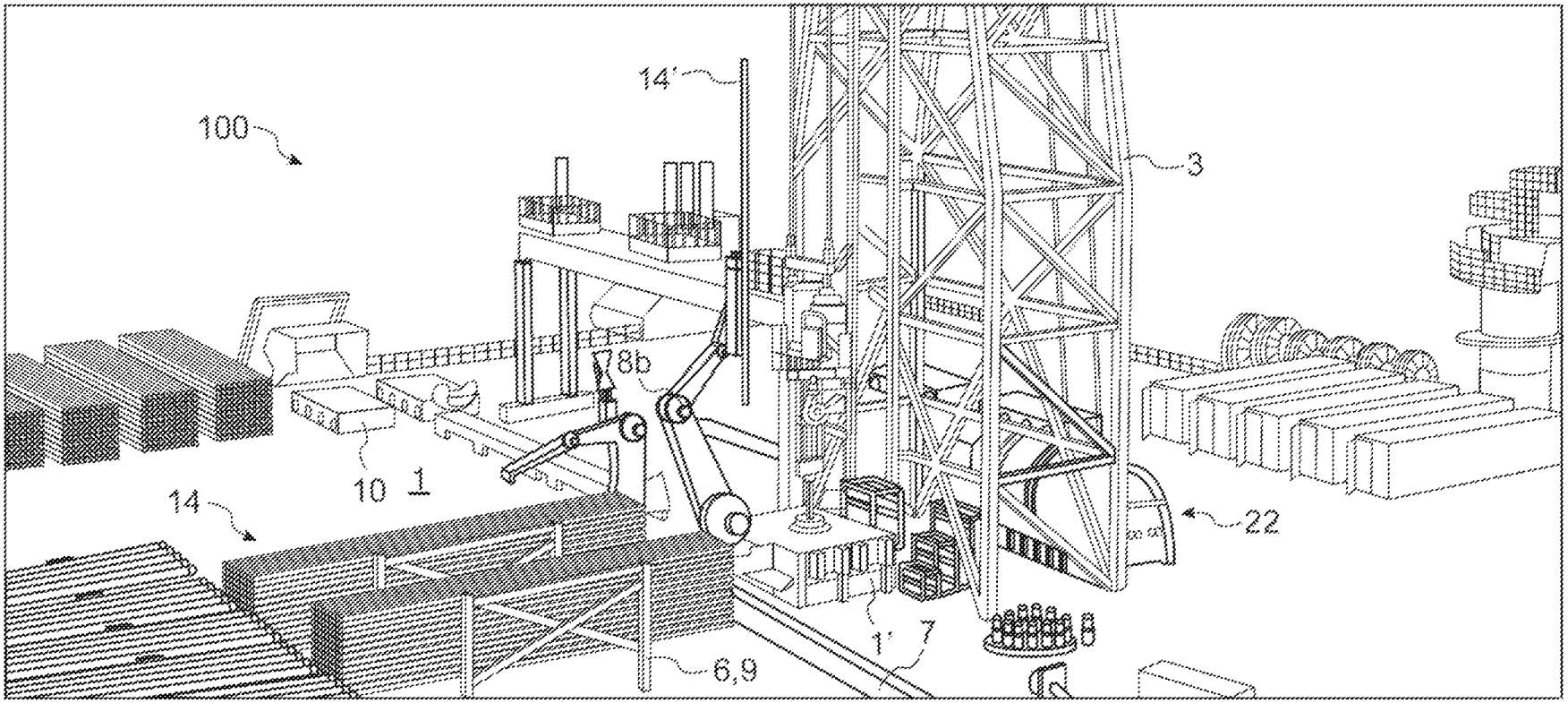
FIG. 10 shows an aspect of a drilling rig having a compensated drill floor section, and in particular where the vertical pipe handling machine can be arranged on the compensated section.
Figure 11:
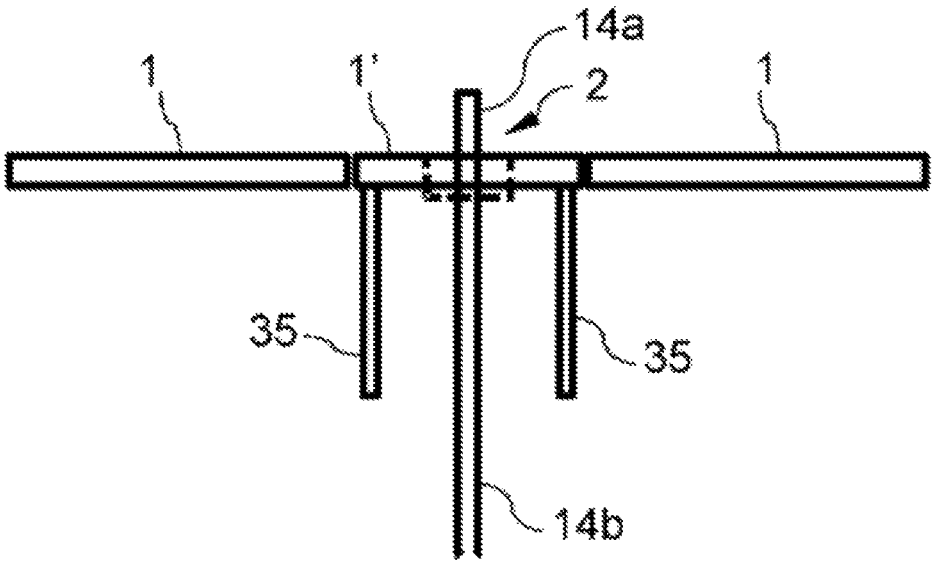
FIG. 11 shows an aspect of a drilling rig having a compensated drill floor section.
Figure 12:
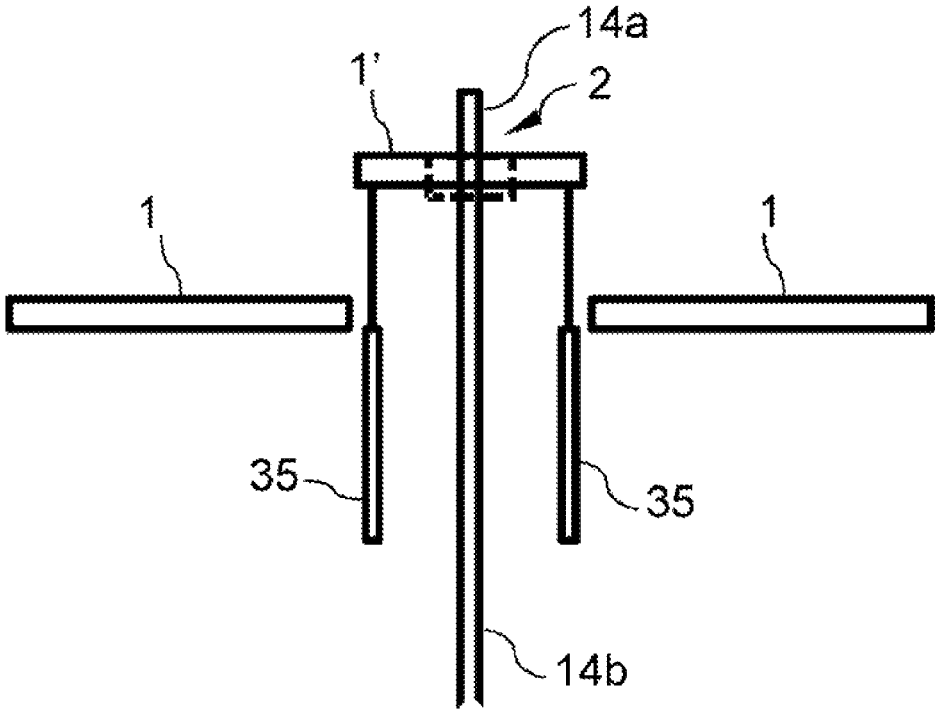
FIG. 12 shows an aspect of a drilling rig having a compensated drill floor section.

FIGS. 10-12 illustrate an embodiment of an elevator 18' which is arranged to be movable between the drill floor 1 and a lower deck. In this example, the elevator 18' is arranged so that utility vehicles 10 can drive onto or off the elevator 18' from the lower deck (see FIGS. 11 and 12) and is arranged to provide other equipment or supplies to be picked up by the crane 103. As illustrated in FIG. 9, the elevator 18' may, however, be adapted to utility vehicles 10 carrying pipe racks 6 with pipe sections 14. The elevator 18' can be configured so that the utility vehicles 10 can drive onto or off the elevator 18' both at the lower deck and at the drill floor 1.

In these embodiments, the pipe racks 6 can thus be stored at a location which is at a different level than the pipe supply area 5 and/or the drill floor 1. This can allow for space savings and added operational flexibility or design flexibility for the drilling rig 100 in that, for example, space constraints on or around the drill floor 1 are relaxed.

According to embodiments as described herein, operational flexibility can be obtained both while building a pipe string and while retrieving a pipe string, allowing the drill floor coordination and logistics to be carried out in an efficient manner. Movement of the pipe sections 14 in the pipe racks 6 can, if desirable, be done while the drilling machine 4 is operating, or while other activities are carried out in the area around the well center opening 2 and the derrick 3.

If providing the pipe sections 14 directly from the pipe racks 6 to the drilling machine 4 for standbuilding while running/drilling, i.e., above the well center opening 2, the need for separate standbuilding equipment and storage (e.g., setback-fingerboard arrangements) can be reduced. The system or method can be used for building a pipe string directly from singles, as illustrated.

An upper pipe handling machine may be provided to assist with the handling of stands to or from the setback.

The setback is arranged within the operational reach 15 (see FIG. 2) of the pipe handling machine(s) 8*a,b* so that the pipe handling machine(s) 8*a,b* can insert or retrieve stands into or out of the setback and move stands between the setback and the well center 2. The setback thus permits tubulars 14, made up into stands, to be temporarily stored and available for use in the well, or temporarily stored after being retrieved from the well.

Optionally, the drilling rig 100 may comprise a mousehole. The mousehole may be arranged within the operational reach 15 (see FIG. 2) of the pipe handling machine(s) 8*a,b* so that the pipe handling machine(s) 8*a,b* can receive or provide a tubular 14 (as a single or made up into a stand) from or to the mousehole. The mousehole may be used for offline standbuilding by providing tubulars 14 from the pipe racks 6 with the pipe handling machine(s) 8*a,b* and making up stands from two or more singles, and/or to break out stands into singles and lay down the singles into the pipe racks 6.

Positioning and "shuffling" of the pipe racks 6 between the pipe supply area 5 and pipe storage area 16 can be performed in an efficient manner via the utility vehicles 10. Movement of the pipe racks 6 can alternatively be performed in a different manner, for example, by forklift, crane, or other means.

FIGS. 10-12 illustrate further embodiments of a drilling rig 100. In these embodiments, the drilling rig comprises a drill floor 1 with a well center opening 2, a derrick 3 with a drilling machine 4 suspended above the well center opening 2, and a vertical pipe handling machine 8*a,b* operable to handle a tubular 14 above the well center opening 2, similarly as described above.

The well center opening 2 is provided on a compensated section 1' of the drill floor 1. The compensated section 1' is a part of the drill floor 1 which is vertically movable in relation to a remainder of the drill floor 1. The well center opening 2, which typically may comprise a rotary table or equivalent arrangements to hang-off the drill string, is thereby vertically movable relative to the rest of the drilling rig 100.

FIGS. 11 and 12 show that one or more actuators 35 may be arranged to adjust the vertical position of the compensated section 1'. The actuators 35 may, for example, be hydraulic cylinders arranged to raise and lower the compensated section 1'. The actuators 35 can be actively controlled so as to adjust the vertical position of the compensated section 1' in response to an input signal, for example, an input signal representing the heave motion of the drilling rig 100. The actuators 35 may optionally be passively controlled, for example, to provide a substantially constant upwards-directed force on the compensated section 1' in order to maintain a tension in the drill string 14*b* within pre-defined limits.

In a lowermost position, the compensated section 1' may be structurally supported such as to be flush with the rest of the drill floor 1. FIG. 1 illustrates this position. The compensated section 1' may be supported vertically in this position by the remainder of the drill floor 1 by the actuators 35 and/or by another part of the drilling rig 100 structure, as appropriate.

Upon activation of the vertical compensation capability, the compensated section 1' may be raised and lowered in relation to the remainder of the drill floor 1 by the actuators, as illustrated in FIGS. 10 and 12.

The compensated section 1' may advantageously be heave compensated in relation to the motion of the drilling rig 100 so that the drill string 14*b* can be kept substantially stationary in relation to the well. This permits the drill string 14*b* to be compensated, i.e., reducing or eliminating heave motion of the drilling rig 100, during the entire drilling and/or tripping processes. This advantageously reduces the risk of damage to the well or adverse effects such as influx from the reservoir during drilling or tripping. With reference to FIGS. 1-6 and the associated description above, the drilling or tripping process may comprise providing sections of drill pipe 14' (as singles or stands) to the drilling machine 4. During lowering of the drill string 14*b* (see FIGS. 4-6 and the associated description above), the drilling machine 4 may be heave compensated, for example, via the hoisting system 22 and/or a dedicated compensator for this purpose. Heave motion from the drilling rig 100 can thereby be counteracted (partly or fully). When adding a new pipe section 14' to the drill string 14*b*, the drill string 14*b* is conventionally hung off in a rotary table or equivalent at the well center opening 2. If the rotary table is fixed, the drill string 14*b* will then follow the motions of the drilling rig 100.

According to the embodiments described here in relation to FIGS. 10-12, when the drill string 14*b* is hung off in the well center opening 2, the compensated section 1' may be controlled to compensate (partly or fully) for any heave motion of the drilling rig 100 so as to maintain the drill string 14*b* stationary (or with reduced motion) in relation to the well. A new pipe section 14' can then be added to the drill string 14*b* while the string is being compensated by the compensated section 1'. When the new pipe section 14' has been added to the string 14*b*, the string 14*b* (including the new section 14') is suspended by the drilling machine 4 which continues the drilling or tripping in process.

FIG. 10 shows that the vertical pipe handling machine 8*b* can be arranged on the compensated section 1'. This allows the pipe handling machine 8*b* to move with the compensated section 1'. The pipe handling machine 8*b* can alternatively be arranged on the remainder of the drill floor 1 and be controlled to follow the movement of the compensated section 1' or the stick-up 14*a* when supplying a new pipe section 14'. Yet alternatively, the pipe handling machine 8*b* may supply the new pipe section 14' to the drilling machine 4 which holds the new pipe section 14' and positions it for connection to the stick-up 14*a*.

The present invention is not limited by the embodiments described above; reference should be had to the appended claims.

LIST OF REFERENCE NUMERALS

1 Drill floor
1' Compensated section (of drill floor 1)
2 Well center opening
3 Derrick
4 Drilling machine
5 Pipe supply area
6 Pipe rack
7 Tracks/Rails
8*a*, 8*b* Pipe handling machine
9 Frame structure
9' Side wall
10 Utility vehicle
11 Underdrive part
12 Base
12' Uppermost surface (of base 12)
13 Motive apparatus
14, 14' Pipe section/Drill pipe
14*a* Stick-up
14*b* Drill string
15 Operational reach
16 Pipe storage area
17 Pipe gripper head
18, 18' Elevator
19 Deck
21 Trolley
22 Hoisting system
26*a* Upper articulated arm
26*b* Lower articulated arm
26*c* Base
35 Actuator
100 Drilling rig
101 Deck
102 Office space
103 Crane
104 Equipment containers
105 Riser storage
106 Lifeboat
x Axis

What is claimed is:

1. An offshore drilling rig comprising:
a drill floor comprising a well center opening;
a derrick comprising a drilling machine which is suspended above the well center opening;
a pipe supply area which is arranged adjacent to the well center opening on the drill floor and arranged on the drill floor or on a horizontal extension of the drill floor, the pipe supply area comprising at least one movable pipe rack which is configured to horizontally store a plurality of pipe sections;
a pipe handling machine which is configured to move at least one of the plurality of pipe sections between a horizontal storage position in the at least one movable pipe rack and a vertical position or a substantially vertical position above the well center opening; and
a pipe storage area,
wherein,
the pipe supply area is further arranged within an operational reach of the pipe handling machine,
the pipe storage area is spaced apart from the pipe supply area and the operational reach of the pipe handling machine,
the pipe supply area and the pipe storage area are each arranged on the drill floor or on the horizontal extension of the drill floor, and
a height difference between the pipe supply area and the pipe storage area does not exist.

2. The offshore drilling rig as recited in claim 1, wherein the plurality of pipe sections in the horizontal storage position in the at least one moveable pipe rack are substantially parallel to an axis which extends from the well center opening towards the pipe supply area.

3. The offshore drilling rig as recited in claim 1, wherein,
the pipe supply area further comprises a plurality of movable pipe racks, and
each of the plurality of movable pipe racks is configured to be movable into the pipe supply area or out of the pipe supply area.

4. The offshore drilling rig as recited in claim 1, wherein each of the at least one moveable pipe rack comprises a frame structure which comprises a receptacle which is configured to hold the plurality of pipe sections.

5. The offshore drilling rig as recited in claim 4, wherein the receptacle is defined by parallel vertical sides.

6. The offshore drilling rig as recited in claim 1, further comprising:

at least one utility vehicle which is configured to move the at least one movable pipe rack on the drill floor or on the horizontal extension of the drill floor.

7. The offshore drilling rig as recited in claim 6, wherein the at least one utility vehicle comprises a base, a drive apparatus, and a ground engaging motive apparatus upon which the base is supported on the drill floor, the drive apparatus being configured to drive the ground engaging motive apparatus so as to move the at least one utility vehicle across the drill floor.

8. The offshore drilling rig as recited in claim 6, wherein each of the at least one movable pipe rack is further configured to be movable between the pipe supply area and the pipe storage area via the at least one utility vehicle.

9. The offshore drilling rig as recited in claim 1, wherein the pipe handling machine is further configured to be movable on the drill floor in a direction which is substantially perpendicular to an axis extending from the well center opening and towards the pipe supply area.

10. The offshore drilling rig as recited in claim 1, wherein the pipe handling machine comprises an articulated arm and a pipe gripper head which is configured to grip and to hold one of the plurality of pipe sections horizontally at the at least one moveable pipe rack and vertically above the well center opening.

11. The offshore drilling rig as recited in claim 1, wherein, the drill floor further comprises a compensated section which is configured to be vertically movable in relation to a remainder of the drill floor, and the well center opening is provided on the compensated section.

12. A method of providing a plurality of pipe sections to a drilling machine which is suspended above a well center opening on an offshore drilling rig, the offshore drilling rig comprising:

a drill floor comprising the well center opening;

a derrick comprising a drilling machine which is suspended above the well center opening;

a pipe supply area which is arranged adjacent to the well center opening on the drill floor and arranged on the drill floor or on a horizontal extension of the drill floor, the pipe supply area comprising a movable pipe rack which is configured to horizontally store the plurality of pipe sections;

a pipe handling machine which is configured to move at least one of the plurality of pipe sections between a horizontal storage position in the movable pipe rack and a vertical position or a substantially vertical position above the well center opening; and a pipe storage area which is spaced apart from the pipe supply area and an operational reach of the pipe handling machine, wherein a height difference between the pipe supply area and the pipe storage area does not exist, the method comprising:

operating the pipe handling machine to pick up the plurality of pipe sections from the horizontal storage position in the movable pipe rack which is arranged in the pipe supply area within the operational reach of the pipe handling machine, the movable pipe rack being movable between the pipe supply area and the pipe storage area which is arranged spaced apart from the pipe supply area;

operating the pipe handling machine to bring the plurality of pipe sections to the vertical position or to the substantially vertical position above the well center opening; and moving the movable pipe rack from the pipe storage area to the pipe supply area, wherein, the moving of the movable pipe rack from the pipe storage area to the pipe supply area is performed via at least one utility vehicle, the at least one utility vehicle comprising a base which is configured to have the movable pipe rack be supported thereon, a drive apparatus, and a ground engaging motive apparatus which is configured to move the at least one utility vehicle between the pipe supply area and the pipe storage area.

13. The method as recited in claim 12, wherein, the at least one utility vehicle further comprises a wireless control signal receiver via which the at least one utility vehicle can receive wireless control signals from a remote controller, the wireless control signals controlling an operation of the drive apparatus.

14. The method as recited in claim 13, wherein, the movable pipe rack comprises an underdrive part which is configured so that the at least one utility vehicle can be positioned at least partly under the movable pipe rack, and the at least one utility vehicle is further configured to elevate the movable pipe rack from the drill floor and to move the movable pipe rack while holding the movable pipe rack elevated.

15. A method of removing a plurality of pipe sections from a drilling machine which is suspended above a well center opening on an offshore drilling rig, the offshore drilling rig comprising:

a drill floor comprising the well center opening;

a derrick comprising a drilling machine which is suspended above the well center opening;

a pipe supply area which is arranged adjacent to the well center opening on the drill floor and arranged on the drill floor or on a horizontal extension of the drill floor, the pipe supply area comprising a movable pipe rack which is configured to horizontally store the plurality of pipe sections;

a pipe handling machine which is configured to move at least one of the plurality of pipe sections between a horizontal storage position in the movable pipe rack and a vertical position or a substantially vertical position above the well center opening; and a pipe storage area which is spaced apart from the pipe supply area and an operational reach of the pipe handling machine, wherein a height difference between the pipe supply area and the pipe storage area does not exist, the method comprising:

operating the pipe handling machine to receive the plurality of pipe sections from the drilling machine in the vertical position or the substantially vertical position above the well center opening; and operating the pipe handling machine to lay down the plurality of pipe sections in the horizontal storage position in the movable pipe rack which is arranged in the pipe supply area within the operational reach of the pipe handling machine.

16. The method as recited in claim 15, wherein, the movable pipe rack is configured to be movable between the pipe supply area and the pipe storage area which is spaced apart from the pipe supply area, and the method further comprises:

moving the movable pipe rack from the pipe supply area to the pipe storage area.

17. The method as recited in claim 15, wherein, the movable pipe rack is one of a plurality of movable pipe racks, and the method further comprises:

successively moving the plurality of movable pipe racks from the pipe supply area to the pipe storage area while operating the drilling machine.

18. The method as recited in claim 17, wherein the step of moving the movable pipe rack or the plurality of movable pipe racks from the pipe supply area to the pipe storage area is performed via at least one utility vehicle, the at least one utility vehicle comprising a base which is configured to have the movable pipe rack or the plurality of movable pipe racks be supported thereon, a drive apparatus, and a ground engaging motive apparatus which is configured to move the at least one utility vehicle between the pipe supply area and the pipe storage area.

19. An offshore drilling rig comprising:

a drill floor comprising a well center opening;

a derrick comprising a drilling machine which is suspended above the well center opening;

a pipe supply area which is arranged adjacent to the well center opening on the drill floor, the pipe supply area comprising at least one movable pipe rack for a horizontal storage of a plurality of pipe sections;

a pipe handling machine which is configured to move the plurality of pipe sections between a horizontal storage position in the at least one movable pipe rack and a vertical position or a substantially vertical position above the well center opening, wherein the pipe supply area is further arranged within an operational reach of the pipe handling machine;

a pipe storage area which is spaced apart from the pipe supply area and the operational reach of the pipe handling machine; and at least one utility vehicle which is configured to move the at least one movable pipe rack on the drill floor or on the horizontal extension of the drill floor, the at least one utility vehicle comprising, a base, a drive apparatus, a ground engaging motive apparatus upon which the base is supported on the drill floor, the drive apparatus being configured to drive the ground engaging motive apparatus so as to move the at least one utility vehicle across the drill floor, and a wireless control signal receiver via which the at least one utility vehicle can receive wireless control signals from a remote controller, the wireless control signals controlling an operation of the drive apparatus, wherein, each of the at least one movable pipe rack is further configured to be movable between the pipe supply area and the pipe storage area via the at least one utility vehicle.

20. The offshore drilling rig as recited in claim 19, wherein the base of the at least one utility vehicle has a substantially planar uppermost surface which is configured to support the at least one movable pipe rack when the at least one movable pipe rack is moved by the at least one utility vehicle.

21. The offshore drilling rig as recited in claim 19, wherein, the at least one movable pipe rack comprises an underdrive part which is configured so that the at least one utility vehicle can be positioned at least partly under the at least one movable pipe rack, and the at least one utility vehicle is further configured to elevate the at least one movable pipe rack from the drill floor and to move the at least one movable pipe rack while holding the at least one movable pipe rack elevated.

22. The offshore drilling rig as recited in claim 19, further comprising:

a lift which is configured so that the at least one utility vehicle can be driven thereon, wherein, at least a part of the pipe storage area is arranged at a different elevation than the pipe supply area, and the at least one utility vehicle is further configured to move each of the at least one movable pipe rack between the part of the pipe storage area which is arranged at the different elevation than the pipe supply area to the pipe supply area via the lift.

* * * * *